US005284172A

United States Patent [19]

Teate, Jr.

[11] Patent Number: 5,284,172

[45] Date of Patent: Feb. 8, 1994

[54] REVERSING UMBRELLA APPARATUS

[76] Inventor: James R. Teate, Jr., 216B Woodburn Dr., Dothan, Ala. 36301

[21] Appl. No.: 848,079

[22] Filed: Mar. 9, 1992

[51] Int. Cl.[5] ..... A45R 25/02

[52] U.S. Cl. ..... 135/27

[58] Field of Search ..... 135/26, 27, 29, 30, 135/31

[56] References Cited

U.S. PATENT DOCUMENTS 869,082 4/1907 Hays ..... 135/26

*Primary Examiner*—Carl D. Friedman
*Assistant Examiner*—Creighton Smith
*Attorney, Agent, or Firm*—Leon Gilden

[57] ABSTRACT

An umbrella member includes a slide slidably mounted about a tubular support shaft. The shaft includes a collar thereon, with the collar including plural pairs of canopy ribs pivotally mounted to the collar, with each of the canopy ribs including a slide housing slidably mounted to the ribs, with each slide housing including support ribs mounted to the slide housing and to the slide. The canopy ribs include a canopy member secured thereto, wherein the slide is arranged in cooperation with the slide housings to reverse the arcuate orientation of the canopy ribs to effect reversal of orientation of the canopy ribs from a downward to an upward position permitting ease of access of the umbrella structure within a limited environment, such as an automotive vehicle.

4 Claims, 4 Drawing Sheets

REVERSING UMBRELLA APPARATUS

BACKGROUND OF THE INVENTION

1. Field of the Invention

The field of invention relates to umbrella apparatus, and more particularly pertains to a new and improved reversing umbrella apparatus wherein the same permits reversal of the canopy structure of the umbrella to permit ease of access of the umbrella within a limited environment, such as an automobile enclosure, without marring the exterior surface of the automobile.

2. Description of the Prior Art

When individuals direct an umbrella structure into an automobile, the normal arcuate orientation of the canopy of the umbrella is prone to encounter with an exterior surface of an automobile in directing the umbrella into the automobile interior passenger compartment. The instant invention overcomes deficiencies of the prior art by providing for reversing of the umbrella structure to permit ease of access of the umbrella structure within the automotive environment. Prior art umbrella structure is exemplified in the U.S. Pat. Nos. 4,865,063; 4,928,718; 4,836,232; 4,736,761; and 4,804,008.

The prior art structure has heretofore failed to set forth the ease of reversing of an umbrella canopy to permit access of an umbrella within an automobile and in this respect, the present invention substantially fulfills this need.

SUMMARY OF THE INVENTION

In view of the foregoing disadvantages inherent in the known types of umbrella apparatus now present in the prior art, the present invention provides a reversing umbrella apparatus wherein the same is arranged for ease of reversing the canopy orientation of the umbrella structure. As such, the general purpose of the present invention, which will be described subsequently in greater detail, is to provide a new and improved reversing umbrella apparatus which has all the advantages of the prior art umbrella apparatus and none of the disadvantages.

To attain this, the present invention provides an umbrella member including a slide slidably mounted about a tubular support shaft. The shaft includes a collar thereon, with the collar including plural pairs of canopy ribs pivotally mounted to the collar, with each of the canopy ribs including a slide housing slidably mounted to the ribs, with each slide housing including support ribs mounted to the slide housing and to the slide. The canopy ribs include a canopy member secured thereto, wherein the slide is arranged in cooperation with the slide housings to reverse the arcuate orientation of the canopy ribs to effect reversal of orientation of the canopy ribs from a downward to an upward position permitting ease of access to the umbrella structure within a limited environment, such as an automotive vehicle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reversing umbrella apparatus which has all the advantages of the prior art umbrella apparatus and none of the disadvantages.

It is another object of the present invention to provide a new and improved reversing umbrella apparatus which may be easily and efficiently manufactured and marketed.

It is a further object of the present invention to provide a new and improved reversing umbrella apparatus which is of a durable and reliable construction.

An even further object of the present invention is to provide a new and improved reversing umbrella apparatus which is susceptible of a low cost of manufacture with regard to both materials and labor, and which accordingly is then susceptible of low prices of sale to the consuming public, thereby making such reversing umbrella apparatus economically available to the buying public.

Still yet another object of the present invention is to provide a new and improved reversing umbrella apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
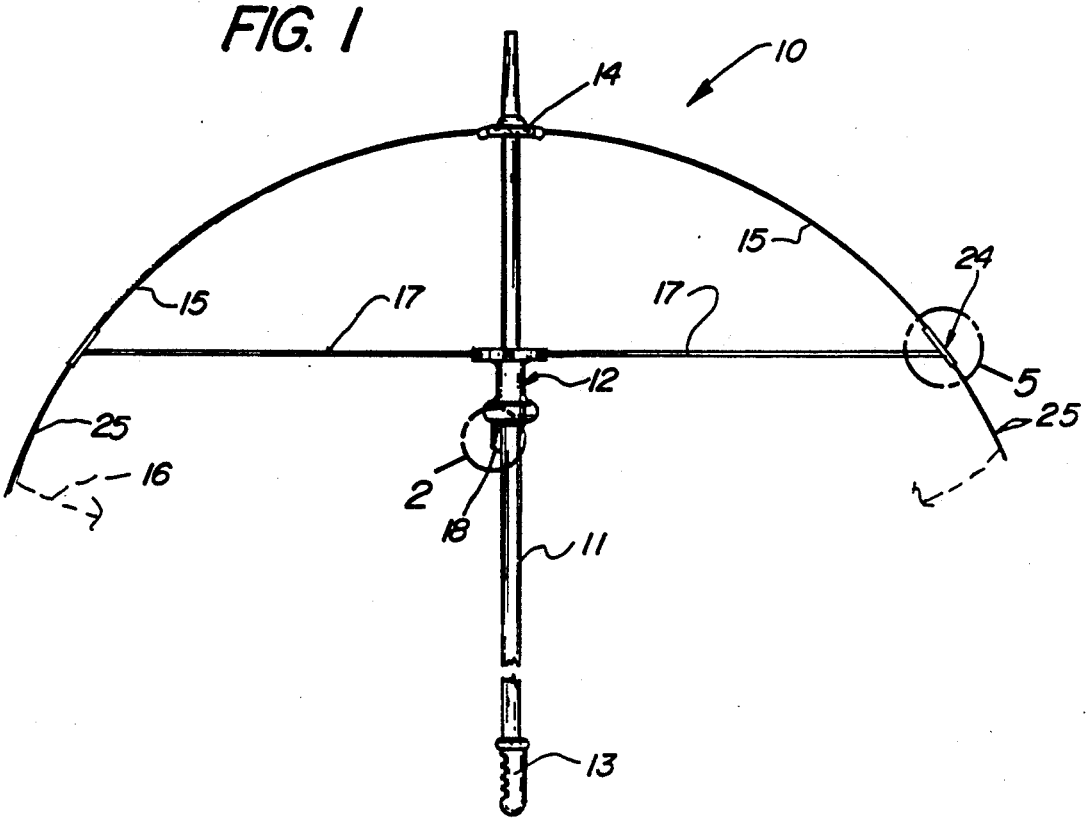
FIG. 1 is an orthographic side view of the instant invention.
Figure 2:
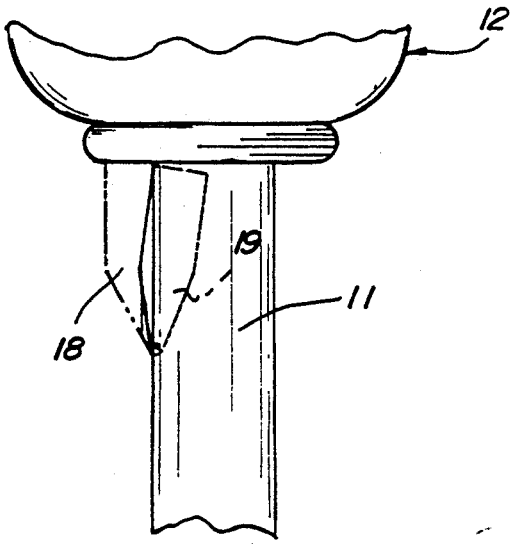
FIG. 2 is an orthographic view of section 2, as set forth in FIG. 1.

With reference now to the drawings, and in particular to FIGS. 1 to 8 thereof, a new and improved reversing umbrella apparatus embodying the principles and concepts of the present invention and generally designated by the reference numeral 10 will be described.

Figure 3:
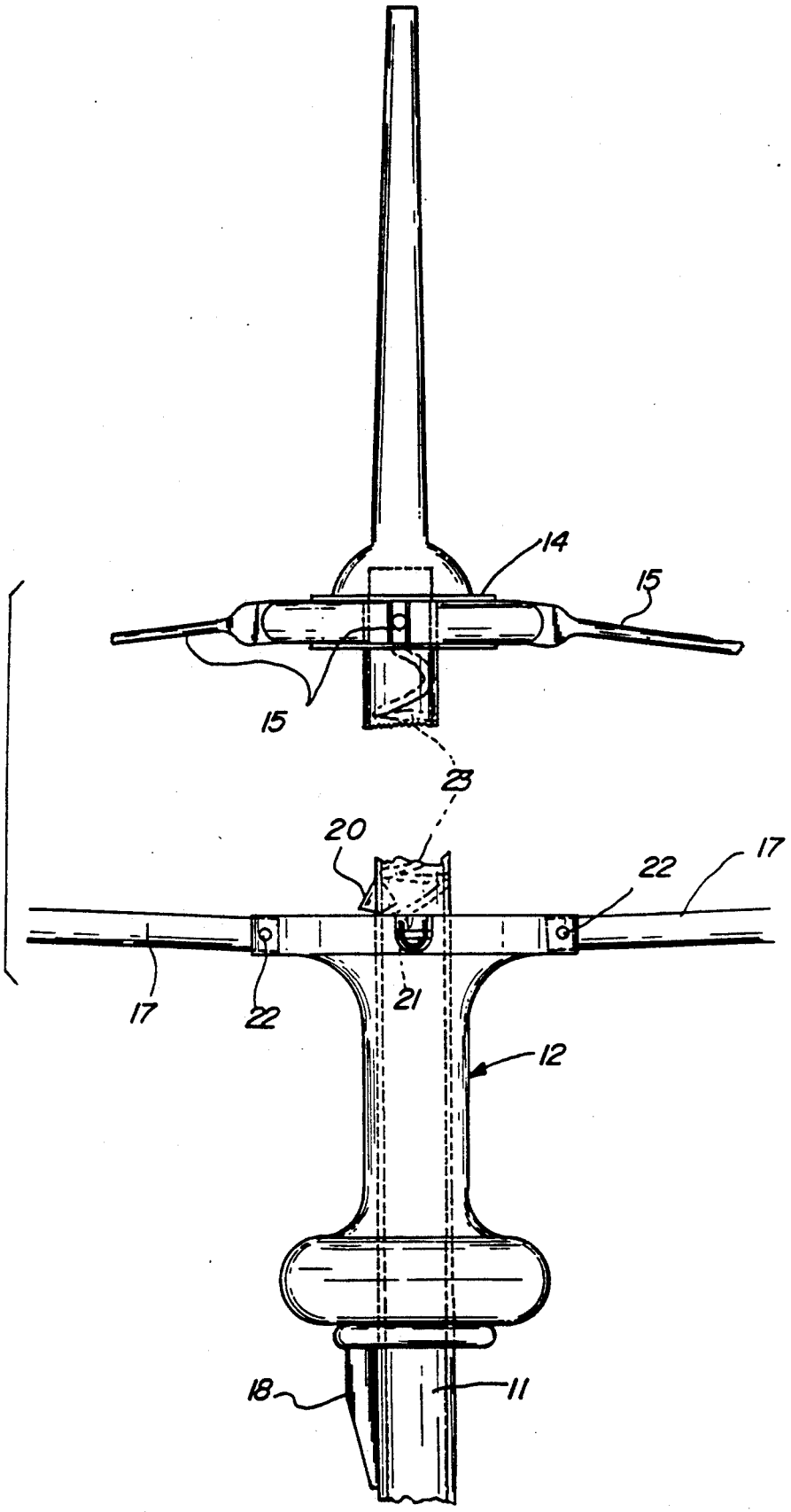
FIG. 3 is an orthographic view of the upper portion of the support shaft and the slide member mounted to the support shaft.
Figure 4:
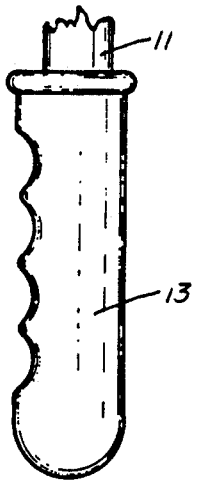
FIG. 4 is an orthographic view of the handle structure of the invention.
Figure 5:
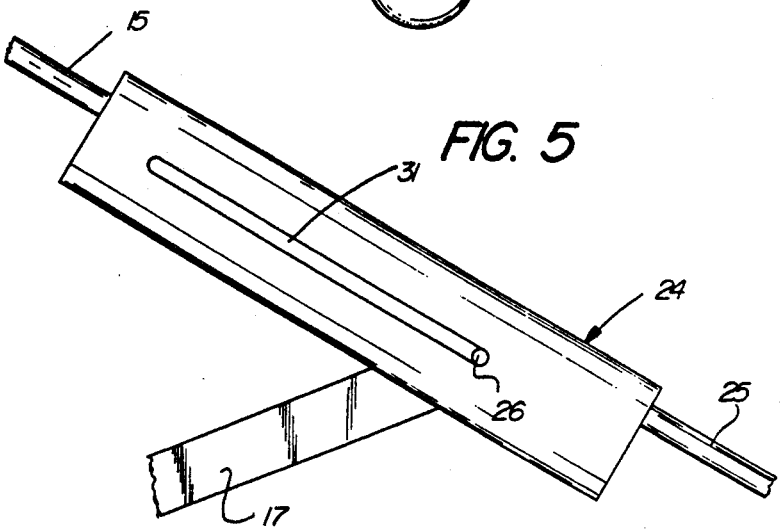
FIG. 5 is an orthographic side view of the slide housing of the invention.
Figure 6:
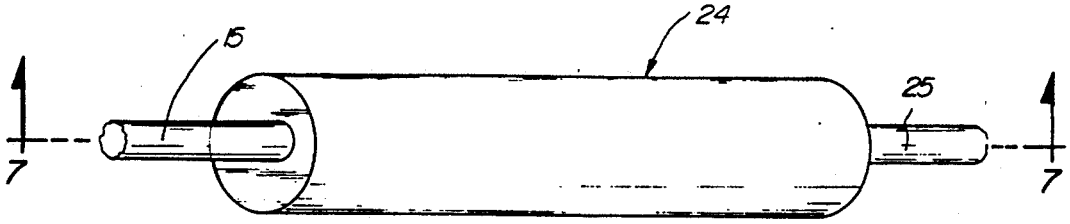
FIG. 6 is an orthographic top view of the slide housing of the invention.
Figure 7:
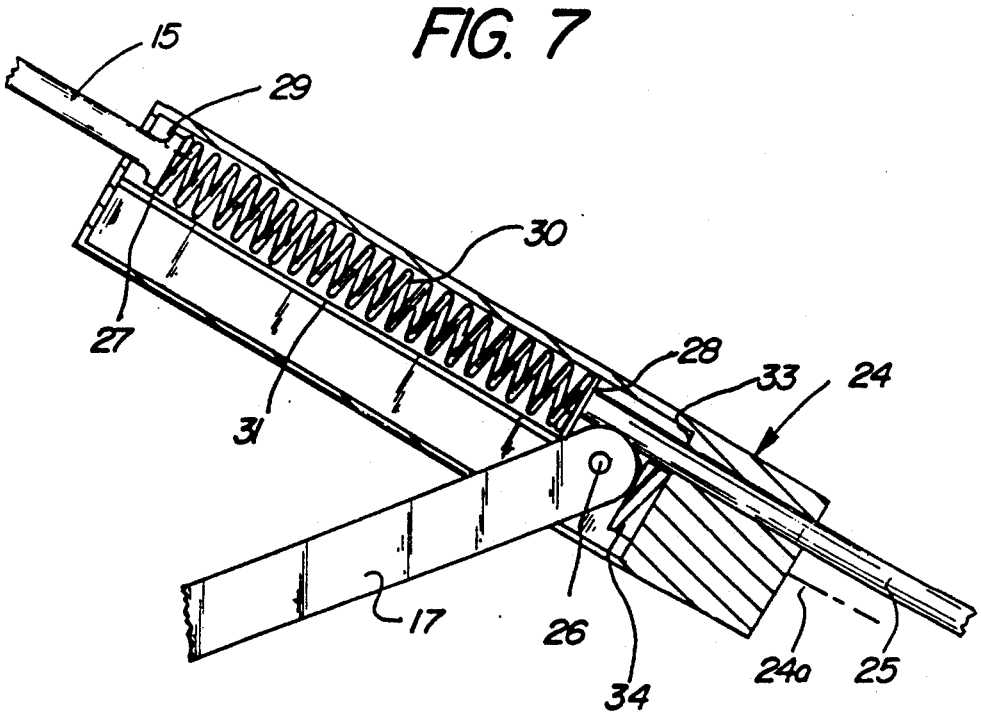
FIG. 7 is an orthographic view, taken along the lines 7—7 of FIG. 6 in the direction indicated by the arrows.
Figure 8:
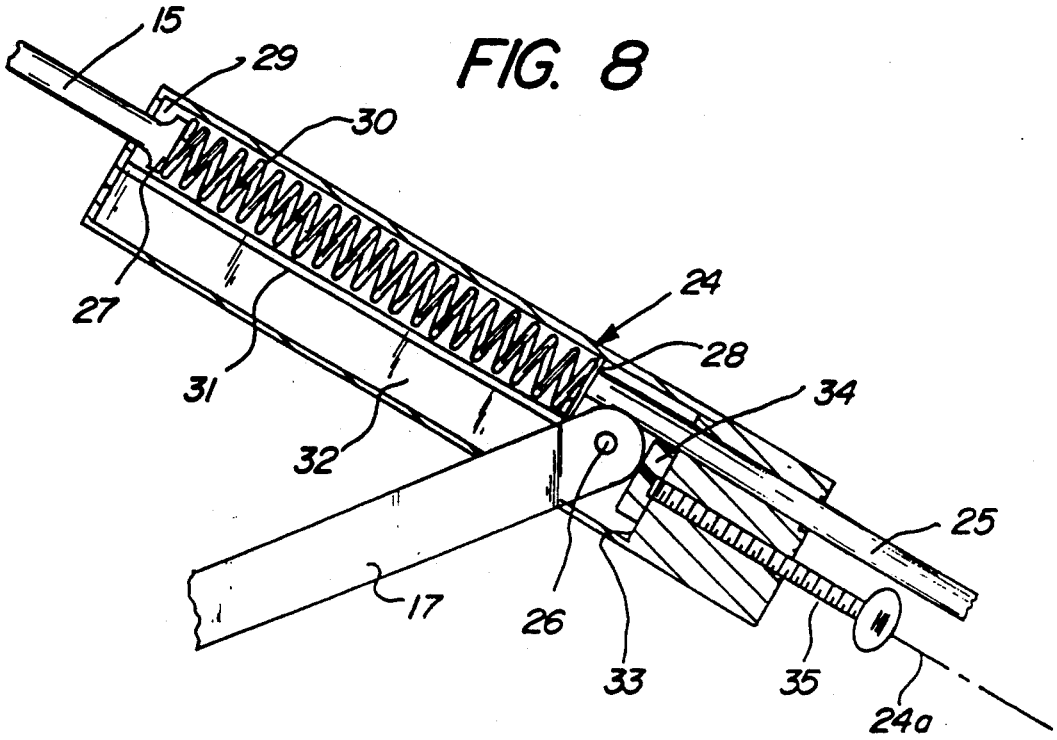
FIG. 8 is an orthographic view of the slide housing utilizing an adjuster member associated therewithin.

More specifically, the reversing umbrella apparatus 10 of the instant invention essentially comprises a tubular support shaft 11 slidably mounting a slide member 12, with the slide member 12 coaxially receiving the support shaft 11 therethrough. The handle 13 is fixedly mounted to a lower distal end portion of the support shaft 11, with a shaft collar 14 mounted to an upper distal end of the support shaft 11. The shaft collar 14 includes plural pairs of canopy ribs 15 diametrically mounted relative to the shaft collar 14 whose upper ends are pivotally mounted to the support shaft 14, in a manner as illustrated in FIG. 3 for example. A plurality of pairs of canopy ribs, as illustrated mounted to the collar 14, are associated with plural pairs of support ribs 17 pivotally mounted to the slide member 12. Rear end portions of the support ribs 17 are pivotally mounted about support rib rear axles 22 to the slide member 12, in a manner as illustrated in FIG. 3. It should be noted that plural pairs of the canopy ribs and associated support ribs are arranged to support a canopy web 16 mounted to the canopy ribs 15, in a manner as illustrated and described in U.S. Pat. No. 4,865,063 in association with the canopy ribs and support rib structure.

A lower latch plate 18 is pivotally mounted to the support shaft 11 and receivable within a lower latch plate cavity 19 within the support shaft 11. An upper latch plate 20 is pivotally mounted to the support shaft 11 and received within an upper latch plate cavity 21 . The lower latch plate 18 and the upper latch plate 20 are spaced apart a predetermined spacing substantially equal to a predetermined length defined by the slide member 12 to permit capture of the slide member therebetween. The support shaft includes a support shaft spring 23 to normally bias the slide member 12 in engagement with the lower latch plate 18.

Each of the lower distal ends of the canopy ribs 15 include a canopy rib rear distal abutment end 27 that is slidably mounted within a canopy rib slide housing 24. A canopy rib extension 25 extends from the slide housing 24, with a canopy rib extension forward distal end plate 28 received within the slide housing 24. The canopy ribs 15 and the canopy rib extensions 25 are coaxially aligned relative to the slide housing 24 relative to a tubular spring housing cavity 29 coaxially receiving a housing spring 30 between the canopy rib rear distal abutment end 27 and the canopy rib extension forward distal plate member 28. Each forward distal end of the support rib 17 includes a support rib forward axle 26 slidably mounted within the housing 24 coaxially aligned therewith and directed through diametrically opposed housing axle slots 31 directed through opposed sides of the housing 24. In this manner, projection of the upper latch plate 20 within the upper latch plate cavity 21 permits projection of the slide member 12 upwardly permitting the canopy rib slide housing 24 to be slid along the canopy ribs 15 to permit overfolding of the associated canopy web 16. A housing cavity 32 includes a housing cavity floor 33 mounting a cushion abutment 34 thereon. In an adjustment of the orientation of the support rib forward, axle 26 within the housing 24, a threaded rod 35 coaxially and threadedly directed through the housing 24 mounts the cushion abutment 34 at its forward distal end to permit projection of the cushion abutment coaxially through the housing cavity providing displacement of the support rib forward axle 26 relative to the housing 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A reversing umbrella apparatus, comprising, a tubular support shaft, the tubular support shaft including a shaft lower distal end and a shaft upper distal end, the shaft lower distal end mounting a handle fixedly thereto, the shaft upper distal end mounting a shaft collar, and the shaft collar pivotally mounting at least one pair of canopy ribs, each rib of said pair of canopy ribs includes a rib upper distal end and a rib lower distal end, the rib upper distal end is pivotally mounted to the shaft collar, and each rib lower distal end including slide means for sliding along said each rib, and a slide member slidably mounted about the tubular support shaft between the shaft collar and the handle, wherein the slide member includes at least one pair of support ribs, with each support rib of said support ribs pivotally mounted to the slide member and to said slide means of each canopy rib, and the slide means includes a slide housing, the slide housing including a slide housing cavity, and the slide housing cavity further including a spring cavity, the slide housing including a slide housing access longitudinally directed through the slide housing, and the spring cavity arranged parallel and spaced from the access, and the canopy rib lower distal end including an abutment flange positioned within the spring cavity, and the slide housing further including a canopy rib extension directed through a lower distal end of the slide housing, wherein the canopy rib extension includes a canopy rib extension upper distal end plate positioned within the spring housing, and a spring member positioned between the canopy rib and the canopy rib extension within the slide housing.

2. An apparatus as set forth in claim 1 wherein each slide housing includes a plurality of axle slots directed through the slide housing oriented parallel relative to the axis, and each support rib includes a support rib forward axle, and each support rib forward axle is directed through the axle slots.

3. An apparatus as set forth in claim 2 wherein the housing cavity includes a housing cavity floor, and the housing cavity floor includes a resilient cushion abutment mounted thereto for receiving the forward distal end of the support rib thereon.

4. An apparatus as set forth in claim 3 wherein each cushion abutment is fixedly mounted to an upper distal end of a threaded rod, the threaded rod is threadedly directed coaxially through the slide housing to permit adjustment of the support rib within the housing cavity.

* * * * *